US009824804B2

(12) United States Patent
Choto et al.

(10) Patent No.: US 9,824,804 B2
(45) Date of Patent: Nov. 21, 2017

(54) COMPOSITE FERRITE COMPOSITION AND ELECTRONIC COMPONENT

(71) Applicant: TDK CORPORATION, Tokyo (JP)

(72) Inventors: Hiroki Choto, Tokyo (JP); Takeshi Shibayama, Tokyo (JP); Takashi Suzuki, Tokyo (JP); Shinichi Kondo, Tokyo (JP); Yuya Oshima, Tokyo (JP); Masaki Takahashi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/089,992

(22) Filed: Apr. 4, 2016

(65) Prior Publication Data

US 2016/0293301 A1 Oct. 6, 2016

(30) Foreign Application Priority Data

Apr. 2, 2015 (JP) ..... 2015-076169
Mar. 15, 2016 (JP) ..... 2016-051094

(51) Int. Cl.

| | |
|---|---|
| ***H01F 17/04*** | (2006.01) |
| ***H01F 1/34*** | (2006.01) |
| ***H01F 17/00*** | (2006.01) |
| ***H01F 27/29*** | (2006.01) |

(52) U.S. Cl.

CPC ..... *H01F 1/344* (2013.01); *H01F 17/0013* (2013.01); *H01F 17/04* (2013.01); *H01F 27/292* (2013.01); *H01F 2017/048* (2013.01)

(58) Field of Classification Search

None

See application file for complete search history.

(56) References Cited

U.S. PATENT DOCUMENTS

| | | | | |
|---|---|---|---|---|
| 6,642,167 | B1 * | 11/2003 | Sugimoto | C04B 35/4686 174/110 A |
| 8,102,223 | B2 * | 1/2012 | Umemoto | C04B 35/18 333/181 |
| 9,305,690 | B2 * | 4/2016 | Choto | H01F 1/401 |
| 2004/0069969 | A1 | 4/2004 | Endo et al. | |
| 2005/0003726 | A1 * | 1/2005 | Zguris | C03C 3/091 442/181 |
| 2013/0093557 | A1 * | 4/2013 | Odahara | H01F 27/2804 336/200 |

(Continued)

FOREIGN PATENT DOCUMENTS

| | | | |
|---|---|---|---|
| CN | 1184650 | C | 1/2005 |
| EP | 0844625 | A2 | 5/1998 |
| JP | 05326243 | A * | 12/1993 |

(Continued)

*Primary Examiner* — Kevin M Bernatz
(74) *Attorney, Agent, or Firm* — Oliff PLC

(57) ABSTRACT

Provided is a composite ferrite composition including a magnetic substance material and a nonmagnetic substance material. The magnetic substance material is Ni—Cu—Zn based ferrite. The nonmagnetic substance material comprises a low dielectric constant nonmagnetic substance material, which is shown by a general formula: a(bZnO.c-CuO).$SiO_2$ and satisfies a=1.5 to 2.4, b=0.85 to 0.98, c=0.02 to 0.15, and b+c=1.00 in said general formula, and a bismuth oxide. A mixing ratio of the magnetic substance material and the low dielectric constant nonmagnetic substance material is 80 wt %:20 wt % to 10 wt %:90 wt %.

8 Claims, 2 Drawing Sheets

(56) References Cited

U.S. PATENT DOCUMENTS

| | | | | |
|---|---|---|---|---|
| 2014/0333405 | A1 | 11/2014 | Choto et al. | |
| 2015/0097137 | A1* | 4/2015 | Wada | H01F 1/01 252/62.6 |

FOREIGN PATENT DOCUMENTS

| | | | | |
|---|---|---|---|---|
| JP | H11-26241 | A | | 1/1999 |
| JP | 2002-175916 | A | | 6/2002 |
| JP | 2002-252109 | A | | 9/2002 |
| JP | 2004-262682 | A | | 9/2004 |
| JP | 2004-262683 | A | | 9/2004 |
| JP | 2004-297020 | A | | 10/2004 |
| JP | 2006131035 | A | * | 5/2006 |
| JP | 2014-220469 | A | | 11/2014 |

* cited by examiner

COMPOSITE FERRITE COMPOSITION AND ELECTRONIC COMPONENT

BACKGROUND OF THE INVENTION

1. Field of the Invention

The present invention relates to composite ferrite compositions superior in high frequency characteristics and to electronic components to which said composite ferrite compositions are applied.

2. Description of the Related Art

In recent years, a frequency band used for such as portable phones, PC, etc. is made a high frequency, and there are already more than one standard having several GHz. Products to remove noise corresponding to signals of such high frequency is demanded. A multilayer chip coil is mentioned as major example thereof.

Electric characteristics of the multilayer chip coil can be evaluated by impedance. The impedance characteristic is greatly influenced by permeability of base body materials and frequency characteristic of base body materials until 100 MHz band. Further, impedance of the GHz band is influenced by stray capacitance between counter electrodes of the multilayer chip coil. Three following methods are mentioned to reduce stray capacitance between counter electrodes of the multilayer chip coil: extending distance between counter electrodes, reducing area of the counter electrode, and reducing dielectric constant between counter electrodes.

In the following Patent Article 1, terminals are formed on both ends of a magnetic flux direction generated by a coil energization, in order to reduce the stray capacitance. According to the invention of Patent Article 1, the distance between an internal electrode and a terminal electrode is extendable, and also an opposing area between the internal electrode and the terminal electrode can be reduced. Thus, frequency characteristic is expected to be extended to the high frequency.

However, according to Patent Article 1, the stray capacitance between internal electrodes is not reduced, and there is a room for further improvement on this matter. Further, extending distance between the internal electrodes and reducing area of the internal electrode are improving methods involving structural change of the multilayer chip coil, and are largely influential to the other characteristics and to size and forms of the multilayer chip coil. Extending distance between internal electrodes is influential to size of the products. Thus, it is difficult to apply to chip devices, which require miniaturization. In addition, reducing area of the internal electrode involves a problem of DC resistance increase.

Recently, Ni—Cu—Zn based ferrite is often used as the base body material of the multilayer chip coil. Ni—Cu—Zn based ferrite is a magnetic ceramic which can be fired at around 900° C., and thus Ni—Cu—Zn based ferrite is often used. Ni—Cu—Zn based ferrite can be fired at around 900° C., and that simultaneous firing with Ag used as the internal electrode is possible. Further, dielectric constant of Ni—Cu—Zn based ferrite is around 14 to 15, which is high. It is determined difficult to lower the dielectric constant of Ni—Cu—Zn based ferrite.

According to Patent Article 2 described below, composite material is manufactured by mixing Ni—Cu—Zn based ferrite and low dielectric constant nonmagnetic substance. Said composite material is applied as the base body material. Silica glass, borosilicate glass, steatite, alumina, forsterite, zircon are mentioned as said low dielectric constant nonmagnetic substance. According to the invention described in Patent Article 2, dielectric constant of the composite material, obtained by mixing Ni—Cu—Zn based ferrite and low dielectric constant nonmagnetic substance, is lowered relative to the dielectric constant of Ni—Cu—Zn based ferrite.

However, according to Patent Article 2, in case when a glass-based material, such as silica glass, borosilicate glass, and the like, is used as main component of the low dielectric constant nonmagnetic substance, permeability of the composite material remarkably declines. It is conceivable that this is due to the glass-based material causing grain growth inhibition or magnetic path separation of magnetic substance. In addition, Ni—Cu—Zn based ferrite and the glass-based material is highly reactive, and thus, forms a hetero phase. Therefore, it is most likely to cause short-circuit by simultaneous firing with Ag-based conductor; and it is inappropriate for an Ag-based conductor applied multilayer coil.

On the other hand, in case when ceramic materials which are not the glass-based material, such as steatite, alumina, forsterite, zircon, etc., is main component of the low dielectric constant nonmagnetic substance, the reaction between Ni—Cu—Zn based ferrite and the ceramic material is difficult to occur, and hardly forms the hetero phase. However, there is a problem of the sintering property in case when ceramic material is used as main component of the low dielectric constant nonmagnetic substance. It is conceived that sintering of the composite material is difficult at firing temperature of 900°, which is possible for co-firing with internal electrode Ag.

The invention according to Patent Article 3 shows an application of a foamed ferrite. Namely, in Patent Article 3, burn-out material is mixed with the magnetic ceramic, pores are manufactured after sintering, and resin or glass is impregnated to the pores. Low dielectric constant is achieved by using the pores. In addition, resin or glass is impregnated to the pores in order to cover demerit of the foamed ferrite, which strength is weakened. Further, there is no problem with characteristics and sintering properties of the invention according to Patent Article 3.

However, according to the invention of Patent Article 3, a terminal electrode cannot be directly formed on the foamed ferrite since the ferrite contains many pores. Therefore, the ferrite with fewer pores must be used at the part where the terminal electrode is formed; and there is a fault that structure becomes complicated. In addition, grain size of the foamed ferrite after firing tends to be small relative to the grain size of the ferrite with fewer pores. Therefore, moisture resistance and so on is most likely deteriorated in case when the foamed ferrite is used.

[Patent Article 1] Japanese Unexamined Patent Publication No. H11-026241

[Patent Article 2] Japanese Unexamined Patent Publication No. 2002-175916

[Patent Article 3] Japanese Unexamined Patent Publication No. 2004-297020

SUMMARY OF THE INVENTION

In case of using a method in which magnetic substance material and nonmagnetic substance material are complicated, the following 5 points particularly become the problems; namely, the 5 points are an improvement of sintering property, an improvement of permeability, high frequency of permeability frequency characteristic, reduction of dielectric constant, and an improvement in strength. It was thought to be difficult to solve these problems simultaneously and to provide a small-sized multilayer coil with high impedance at GHz band.

The present invention has been made by considering the above circumstances, and the object of the invention is to provide a composite ferrite composition, which is superior in the sintering property, having high specific resistance, showing relatively high permeability and low dielectric constant, which is superior in frequency characteristic of permeability, and having high strength, specially bending strength, and thus hardly generates cracks. The object of the invention is also to provide a small-sized electronic component, in which the above-mentioned composite ferrite composition is applied.

In order to achieve said object, a composite ferrite composition according to the invention is the composite ferrite composition including the magnetic substance material and the nonmagnetic substance material. Said magnetic substance material is Ni—Cu—Zn based ferrite. Said nonmagnetic substance material is shown by a general formula: $a(bZnO.cCuO).SiO_2$. And said nonmagnetic substance material includes the low dielectric constant nonmagnetic substance materials, which satisfy a=1.5 to 2.4, b=0.85 to 0.98, c=0.02 to 0.15, and b+c=1.00 in the above general formula, and bismuth oxides. Mixing ratio of the magnetic substance material and the low dielectric constant nonmagnetic substance material is 80 wt %:20 wt % to 10 wt %:90 wt %.

Composite ferrite composition according to the invention uses Ni—Cu—Zn based ferrite, and thus, it is relatively superior in sintering property at low temperature. Further, according to the invention, the inventors have found that the composite ferrite composition which is superior in sintering property, shows high permeability and low dielectric constant, and is superior in frequency characteristic of permeability and strength is realized by including predetermined nonmagnetic substance material in a predetermined ratio to Ni—Cu—Zn based ferrite.

Namely, according to the invention, it is conceived that inclusion of the low dielectric constant nonmagnetic substance materials having low fluidity at a predetermined ratio in Ni—Cu—Zn based ferrite is possible to lower a magnetic wall moving area of the Ni—Cu—Zn based ferrite and minimize the magnetic path separation. In addition, an influence of an element interdiffusion can be reduced by selecting, among the ceramic materials having low fluidity, nonmagnetic ceramic material including the ceramic materials, which include Zn oxide as the main composition. The low dielectric constant nonmagnetic substance materials include many Zn, which is contained in Ni—Cu—Zn based ferrite, and thus, the element interdiffusion between two materials is considered to become low between the two materials. In addition, even when element inter diffusion is generated, only an amount of element originally contained varies slightly and has small effect on the characteristics.

Note, there is an advantage of being capable for suitably controlling permeability and dielectric constant by arbitrarily varying Ni—Cu—Zn based ferrite composition in the magnetic substance material, nonmagnetic substance material composition, and mixing ratio of the magnetic substance material and the low dielectric constant nonmagnetic substance material.

The composite ferrite composition of the invention includes bismuth oxides. The composite ferrite composition preferably includes 0.5 to 8.0 parts by weight of the bismuth oxide in terms of $Bi_2O_3$, in case when a total of the magnetic substance material and the low dielectric constant nonmagnetic substance material is 100 parts by weight.

Sintering property of the whole composite material is capable of being heightened by adding the bismuth oxide in a predetermined weight ratio as the nonmagnetic substance material. In addition, both high permeability and low dielectric constant of the composite material is achieved, strength is further heightened, and an application to a small-sized multilayer coil device is made possible.

An electronic component of the invention is the electronic component in which coil conductors and ceramic layers are laminated. The coil conductors include Ag. The ceramic layer comprises the composite ferrite composition mentioned above.

DESCRIPTION OF THE PREFERRED EMBODIMENTS

Hereinafter, the present invention will be described based on the embodiments shown by the figures.

Figure 1:
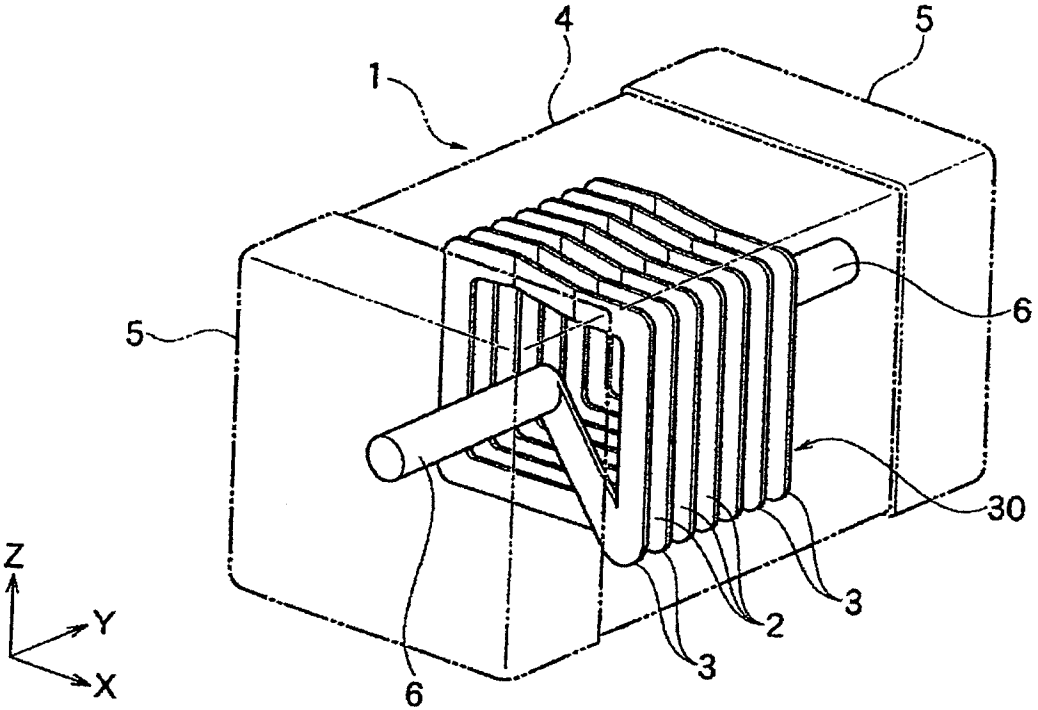
FIG. 1 is an inner visible perspective view of the multilayer chip coil as an electronic component according to an embodiment of the present invention.

As is shown in FIG. 1, the multilayer chip coil 1 as an electronic component according to an embodiment of the invention has the chip body 4, in which the ceramic layer 2 and the internal electrode layer 3 are alternately laminated in Y-axis direction.

Each internal electrode layer 3 is a square ring or C-shaped or U-shaped form, and is connected in a spiral form by a through-hole electrode (not shown in the figures) for connecting the internal electrode which penetrates the adjacent ceramic layer 2 or by a step shaped electrodes, and constitutes the coil conductor 30.

Terminal electrodes 5, 5 are each formed on both end parts of the chip body 4 in Y-axis direction. An end part of the through-hole electrode 6 for connecting the terminals which penetrate multilayered ceramic layer 2 is connected to each terminal electrode 5, and each terminal electrode 5, 5 is connected to both ends of the coil conductor 30 which constitutes a closed magnetic path coil (a winding pattern).

In the present embodiment, laminating direction of the ceramic layer 2 and internal electrode layer 3 corresponds to Y-axis, and end faces of terminal electrodes 5, 5 are parallel to X-axis and Z-axis. X-axis, Y-axis and Z-axis are mutually perpendicular. In the multilayer chip coil 1 shown in FIG. 1, winding shaft of the coil conductor 30 almost corresponds to Y-axis.

Outer form or size of the chip body 4 is not particularly limited, and suitably set according to use. Said outer form is almost rectangular parallel formed shape and the size in X-axis is 0.15 to 0.8 mm, the size in Y-axis is 0.3 to 1.6 mm, and the size in Z-axis is 0.1 to 1.0 mm.

Further, the thickness between electrodes of the ceramic layer 2 and the thickness of the base are not particularly limited; and the thickness between electrodes (the gap between internal electrode layers 3, 3) may be set to around 3 to 50 μm, and the thickness of the base (length in Y axis direction of the through-hole electrode 6 for connecting the terminals) may be set to around 5 to 300 μm.

In the present embodiment, the terminal electrode 5 is not particularly limited, and the terminal electrode 5 is formed by adhering a conductive paste, having Ag or Pd as its main component, on outer surface of the chip body 4, subsequently baking, and further applying electro plating. Cu, Ni, Sn, and so on can be used as the electro plating.

Coil conductor 30 includes Ag (including an Ag alloy), and is constituted by for instance, an Ag simple substance, an Ag—Pd alloy, and so on. Zr, Fe, Mn, Ti and their oxides can be included as a subcomponent of the coil conductor 30.

Ceramic layer 2 is constituted by the composite ferrite composition according to an embodiment of the invention. Hereinafter, the composite ferrite composition is described in detail.

Composite ferrite composition according to the present embodiment includes the magnetic substance and the nonmagnetic substance.

Ni—Cu—Zn based ferrite is used as the magnetic substance material. Composition of Ni—Cu—Zn based ferrite is not particularly limited, and various compositions can be selected depending on the purpose. It is preferable to use the ferrite composition, in which content ratio of each component in the ferrite sintered body after firing is $Fe_2O_3$: 40 to 50 mol %, particularly 45 to 50 mol %, NiO: 4 to 50 mol %, particularly 10 to 40 mol %, CuO: 4 to 20 mol %, particularly 6 to 13 mol %, and ZnO: 0 to 40 mol %, particularly 1 to 30 mol %. In addition, cobalt oxide is preferably included within a range of 10 wt % or less.

In addition, the ferrite composition according to the present embodiment may include, other than the above subcomponent, additional components such as manganese oxide such as $Mn_3O_4$, zirconium oxide, tin oxide, magnesium oxide, glass compound, and so on within amounts not to inhibit the effect of the invention. Although content amount of the additional component is not particularly limited, for instance, it is around 0.05 to 1.0 wt %.

Further, the ferrite composition according to the present embodiment may include an oxide of inevitable impurity elements.

Concrete examples of the inevitable impurity element are C, S, Cl, As, Se, Br, Te, I, typical metal elements such as Li, Na, Al, Ca, Ga, Ge, Sr, Cd, In, Sb, Ba, Pb, transition metal elements such as Sc, Ti, V, Cr, Y, Nb, Mo, Pd, Ag, Hf, Ta. In addition, oxides of the inevitable impurity elements may be included in the ferrite composition if it is around 0.05 wt % or less.

Magnetic characteristic of the magnetic ferrite has a strong composition dependency; and when the compositions of $Fe_2O_3$, NiO, CuO and ZnO are within the above range, permeability or quality coefficient Q tends to improve. In concrete, for instance, permeability tends to improve when an amount of $Fe_2O_3$ is within the above range. In addition, permeability tends to improve when NiO and ZnO amounts are within the above range. Further, it becomes easy to maintain Curie temperature to 100° C. or more when ZnO amount is within the above range; and thus, it tends to become easy to satisfy the temperature characteristic requested for the electronic component. Further, it becomes easy to fire at a low temperature of 930° C. or less, when CuO amount is within the above range; and thus, quality coefficient Q tends to improve when specific resistance of the ferrite specific resistance increases.

Although an average particle size of the ferrite powder is not particularly limited, it is preferably within a range of 0.1 to 1.0 μm. In case when the particle size is within the above range, specific surface area of the ferrite powder becomes preferable, and it becomes easy to make the paste coating for printing lamination or to make the sheet coating for sheet lamination. Further, upon controlling the particle size 0.1 μm or more, pulverize time by pulverize device such as ball mill can be made comparatively short. Namely, risk of generating a contamination from a ball mill and a pulverize vessel due to a long time pulverization and risk of generating a compositional unevenness of ferrite powder can be reduced. Further, upon controlling the particle size 1.0 μm or less, sintering property at low temperature improves and co-firing with internal conductor including Ag becomes easy.

Note measuring method of an average grain size of the ferrite powder is not particularly limited. For instance, the ferrite powder is put in the pure water, dispersed by ultrasonic device, and the average grain size can be measured by such as a laser diffraction grain size distribution measuring apparatus (HELOS SYSTEM made by JEOL Ltd.)

The nonmagnetic substance material includes the low dielectric constant nonmagnetic substance material, which is shown by a general formula: $a(bZnO.cCuO).SiO_2$ and satisfies a=1.5 to 2.4, b=0.85 to 0.98, c=0.02 to 0.15, and b+c=1.00 in said general formula.

"a" is preferably 1.8 to 2.2. "b" is preferably 0.95 to 0.98. "c" is preferably 0.02 to 0.05. And b+c=1.00 is satisfied.

Note low dielectric constant of the low dielectric constant nonmagnetic substance material defines that the dielectric constant is lower than said magnetic substance material.

Mixing ratio of the magnetic substance material and the low dielectric constant nonmagnetic substance material is 80:20 to 10:90, and preferably 50:50 to 20:80 based on a weight standard. In case when ratio of the magnetic substance material is excessively large, dielectric constant of the composite ferrite composition becomes high, high impedance at GHz band cannot be obtained, and a high frequency characteristic is deteriorated. In addition, when including bismuth oxide, an abnormal grain growth at firing is likely to generate. Further, when ratio of the magnetic substance material is excessively small, permeability of the composite ferrite composition becomes low, and impedance from 100 MHz band to GHz band becomes low.

The nonmagnetic substance material according to the present embodiment includes bismuth oxide. In case when bismuth oxide is not included, sintering property declines and strength declines.

The bismuth oxide is included for 0.5 to 8.0 parts by weight, preferably 1.0 to 5.0 parts by weight, more preferably 1.0 to 3.0 parts by weight, and the most preferably 1.5 to 2.0 parts by weight, in case when a total amount of the magnetic substance material and the low dielectric constant nonmagnetic substance material is 100 parts by weight. Upon controlling content amount of the bismuth oxide within a predetermined range, sintering property, permeability, dielectric constant, specific resistance and bending strength can be suitably controlled. In addition, a defect of Ag exudation upon co-firing with the internal electrode substantially including only Ag becomes difficult to generate, by controlling content amount of the bismuth oxide within a predetermined range. Therefore, upon using the internal electrode substantially including only Ag, it is preferable to control the content amount of bismuth oxide within a predetermined range. Note "substantially including only Ag" defines that content amount of Ag to the whole internal conductor is 95 wt % or more.

Strength tends to increase as content amount of bismuth oxide becomes high. Dielectric constant tends to decline and specific resistance tends to increase as content amount of bismuth oxide becomes low.

In addition, a part of bismuth oxide can be replaced by borosilicate glass in the present embodiment. Note the content amount of borosilicate glass is preferably 0.5 parts by weight or less, and it is more preferable not to include borosilicate glass.

An average particle size of the low dielectric constant nonmagnetic substance material and the average particle size of the bismuth oxide are not particularly limited. An average particle size of the low dielectric constant nonmagnetic substance material is preferably 0.2 to 0.6 μm, and an average particle size of the bismuth oxide is preferably 0.5 to 4.0 μm. Measuring method of the average particle size of the low dielectric constant nonmagnetic substance material and the same of the average particle size of the bismuth oxide is the same with the measuring method of the average particle size of ferrite powder.

Hereinafter, manufacturing method of the multilayer chip coil 1 shown in FIG. 1 will be described.

Multilayer chip coil 1 shown in FIG. 1 can be manufactured by a general manufacturing method. Namely, the chip body 4 can be formed by alternately print laminating a composite ferrite paste, obtained by kneading the composite ferrite composition of the present invention, binders, and solvents, and the internal electrode paste including such as Ag, and then by firing (a printing method). The chip body 4 can also be formed by manufacturing green sheet using the composite ferrite paste, printing the internal electrode paste on the surface of the green sheet, laminating thereof, and then firing thereof (a sheet method). In any method, terminal electrode 5 can be formed by baking, plating, and so on, after forming the chip body 4.

Content amounts of the binders and the solvents in the composite ferrite paste are not particularly limited. For instance, content amount of the binder can be set within a range of 1 to 10 wt %, and the same of the solvent can be set within a range of 10 to 50 wt %. In addition, in the paste, dispersant, plasticizer, dielectrics, insulators, and so on may be included within 10 wt % or less, when necessary. The internal electrode paste including such as Ag can be manufactured in the same way. Further, firing condition is not particularly limited, however, the firing temperature is preferably 930° C. or less, and more preferably 900° C. or less, upon including Ag and the like in the internal electrode layer.

Note the present invention is not particularly limited to the above mentioned embodiments, and can be varied within a range of the present invention.

Figure 2:
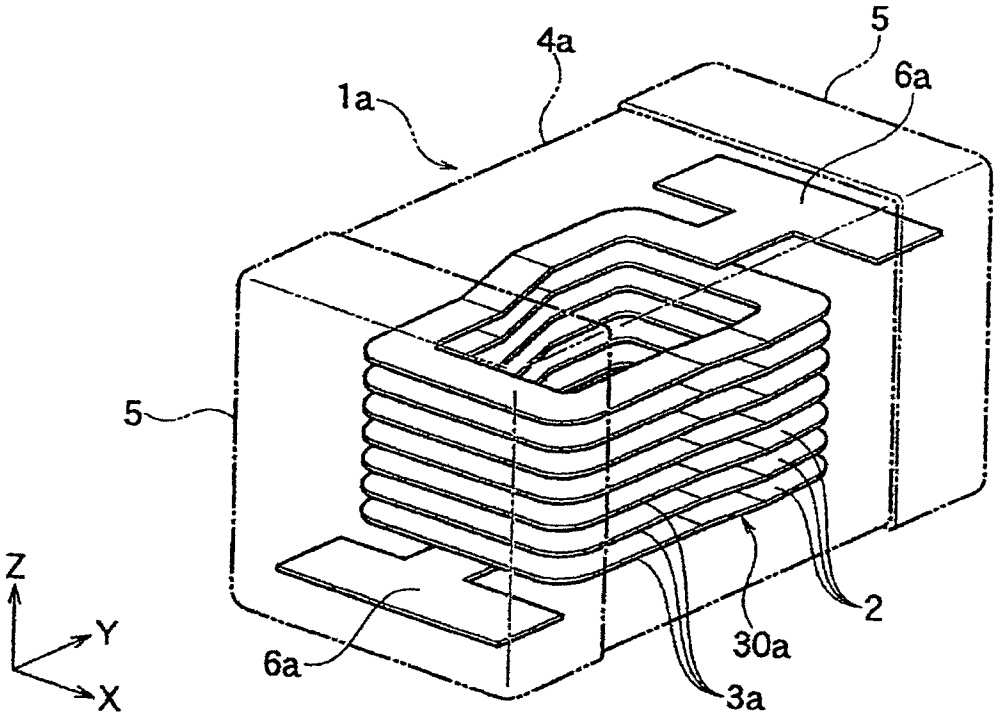
FIG. 2 is an inner visible perspective view of the multilayer chip coil as an electronic component according to the other embodiment of the present invention.

For instance, the ceramic layer 2 of the multilayer chip coil 1*a* shown in FIG. 2 can be constituted by using the composite ferrite composition according to the abovementioned embodiment. The multilayer chip coil 1*a* shown in FIG. 2 has the chip body 4*a*, in which the ceramic layer 2 and the internal electrode layer 3*a* are alternately laminated in Z-axis direction.

Each internal electrode layer 3*a* is a square ring or C-shaped or U-shaped form, and is connected in a spiral form by a through-hole electrode (not shown in the figures) for connecting the internal electrode which penetrates the adjacent ceramic layer 2 or by a step shaped electrodes, and constitutes the coil conductor 30*a*.

Terminal electrodes 5, 5 are each formed on both end parts of the chip body 4*a* in Y-axis direction. An end part of an extracting electrode 6*a*, placed top and bottom of Z-axis direction, is connected to each terminal electrode 5, and each terminal electrode 5, 5 is connected to both ends of the coil conductor 30 which constitutes a closed magnetic path coil.

In the present embodiment, laminating direction of the ceramic layer 2 and internal electrode layer 3 corresponds to Z-axis, and end faces of terminal electrodes 5, 5 are parallel to X-axis and Z-axis. X-axis, Y-axis and Z-axis are mutually perpendicular. In the multilayer chip coil 1*a* shown in FIG. 2, winding shaft of the coil conductor 30*a* almost corresponds to Z-axis.

According to the multilayer chip coil 1 shown in FIG. 1, winding shaft of the coil conductor 30 extends along Y-axis direction, which is the longitudinal direction of the chip body 4. And thus, relative to the multilayer chip coil 1*a* shown in FIG. 2, number of turns can be increased and there is an advantage of being easy to attain high impedance at high frequency band. The other constitution and operation effects of the multilayer chip coil 1*a* shown in FIG. 2 are similar to the same of the multilayer chip coil 1 shown in FIG. 1.

In addition, the composite ferrite composition of the invention can be used for electronic component other than the multilayer chip coil shown in FIGS. 1 and 2. For instance, the composite ferrite composition of the present invention can be used as the ceramic layer, laminated with the coil conductor. In addition, the composite ferrite composition of the invention can be used for a composite electronic component, in which a coil, such as LC composite device, and the other element, such as a condenser, are combined.

EXAMPLES

Hereinafter, the present invention will be described based on the further details of the examples; however, the invention is not limited to the examples.

Example 1

Firstly, Ni—Cu—Zn based ferrite (the average particle size of 0.3 μm) showing permeability: 110 and dielectric constant: 14.0 when solely fired at 900° C. was prepared as the magnetic substance material.

$2(0.98ZnO.0.02CuO).SiO_2$ (the average particle size of 0.5 μm) was prepared as the low dielectric constant nonmagnetic substance material. The low dielectric constant nonmagnetic substance material showed permeability: 1 and dielectric constant: 6, when 1.5 parts by weight of the bismuth oxide (the average particle size of 2 μm) with respect to 100 parts by weight of the nonmagnetic substance material, in terms of $Bi_2O_3$, was mixed and then fired.

The above-mentioned magnetic substance material and the above-mentioned low dielectric constant nonmagnetic substance material were mixed, in order to make the mixing ratio of the above-mentioned magnetic substance material and the above-mentioned low dielectric constant nonmagnetic substance material as shown in Table 1. Further 1.5 parts by weight of the bismuth oxide (the average particle size of 2 μm) with respect to 100 parts by weight of a total of the magnetic substance material and the low dielectric constant nonmagnetic substance material, in terms of $Bi_2O_3$, were weighed respectively. The weighed bismuth oxide, the magnetic substance material, and the low dielectric constant nonmagnetic substance material were wet mixed for 24 hours by a ball mill; the obtained slurry was dried by a dryer, and a composite material was obtained.

An acrylic resin-based binder was added to the obtained composite material, and made to a granule. Said granule was pressure formed and respectively obtained a formed body of toroidal shape (size=outer diameter of 18 mm×inner diameter of 10 mm×height of 5 mm), a formed body of a disk shape (size=outer diameter of 25 mm×thickness of 5 mm), and a formed body of a quadratic prism shape (size=width of 5 mm×length of 25 mm×thickness of 4 mm). Said formed bodies were fired in air at 900° C. for 2 hours and obtained sintered bodies (the composite ferrite compositions). Further, the following characteristic evaluations were performed to the obtained sintered bodies.

Evaluation

[Relative Density]

According to the sintered body forming a disk shape, the sintered body density was calculated from size and weight of the sintered body after firing, and then said sintered body density with respect to theoretical density was calculated as a relative density. According to the present example, the relative density of 90% or more was determined good. Results are shown in Table 1.

[Permeability]

10 turns of a copper wire were wound around the sintered body forming the toroidal shape, and initial permeability was measured by using the impedance analyzer (trade name: 4991A made by Agilent Technologies). Measuring conditions were a measurement frequency of 10 MHz and measurement temperature of 20° C. In the present example, 1.5 or more permeability at 10 MHz was determined good. Results are shown in Table 1.

[Resonance Frequency]

10 turns of a copper wire were wound around the sintered body forming a toroidal shape, and a resonance frequency of the permeability at a room temperature was measured by using the impedance analyzer (trade name: 4991A made by Agilent Technologies). The frequency characteristic of the permeability was made high frequency as a resonance frequency of the permeability is high. In the present example, 50 MHz or more of a resonance frequency of permeability was determined good. Results are shown in Table 1.

[Relative Dielectric Constant]

The network analyzer (8510C made by Hewlett Packard Co.) was used to the sintered body forming a toroidal shape, and relative dielectric constant (no unit) was calculated by resonance method (JIS R 1627). In the present example, relative dielectric constant of 11 or less was determined good. Results are shown in Table 1.

[Specific Resistance]

In—Ga electrode was coated on both sides of the sintered body forming a disk shape, measured DC resistance value, and specific resistance (unit: Ω·m) was obtained. The measurement was carried out by IR meter (4329A made by Hewlett Packard Co.). In the present example, $10^6$ Ω·m or more specific resistance was determined good. Results are shown in Table 1.

[Bending Strength]

3 point bending test was carried out with respect to the sintered body forming a quadratic prism shape, and then broke the sintered body. The bending strength when broken was measured. Note INSTRON 5543 was used for this 3 point bending test. Results are shown in Table 1.

TABLE 1

| No. | Mixing Ratio Magnetic substance material:Low dielectric constant nonmagnetic substance material | $Bi_2O_3$ [parts by weight] | Relative density [vol %] | Permeability | Resonance Frequency [MHz] | Relative dielectric constant | Resistivity [Ω · m] | Bending strength [MPa] |
|---|---|---|---|---|---|---|---|---|
| 1* | 100%:0% | 1.50 | 99.83% | 111.92 | 22.70 | 14.02 | 2.9E+07 | 135.49 |
| 2* | 90%:10% | 1.50 | 97.43% | 14.39 | 155.09 | 12.41 | 6.5E+05 | 121.15 |
| 3 | 80%:20% | 1.50 | 97.83% | 9.13 | 208.92 | 10.81 | 5.3E+06 | 134.15 |
| 4 | 70%:30% | 1.50 | 98.42% | 6.08 | 219.49 | 9.97 | 1.8E+07 | 124.73 |
| 5 | 60%:40% | 1.50 | 98.15% | 4.72 | 211.51 | 9.27 | 3.8E+08 | 127.92 |
| 6 | 50%:50% | 1.50 | 98.42% | 3.76 | 208.46 | 8.42 | 3.1E+08 | 129.02 |
| 7 | 40%:60% | 1.50 | 99.11% | 3.14 | 224.15 | 7.99 | 6.7E+08 | 129.78 |
| 8 | 30%:70% | 1.50 | 98.60% | 2.36 | 240.90 | 7.31 | 4.8E+08 | 135.42 |
| 9 | 20%:80% | 1.50 | 99.86% | 1.83 | 345.83 | 6.93 | 5.8E+11 | 120.67 |
| 10 | 10%:90% | 1.50 | 99.53% | 1.55 | 414.92 | 6.46 | 6.1E+11 | 124.87 |
| 11* | 0%:100% | 1.50 | 99.12% | 1.00 | — | 5.98 | 2.7E+12 | 122.23 |

"*" is Comp. Ex.

It was confirmed that the composite ferrite composition, in which the mixing ratio of the magnetic substance material and the low dielectric constant nonmagnetic substance material is within the range of the invention, shows favorable results for every evaluation items of the relative density, the permeability, the resonance frequency, the relative dielectric constant, the specific resistance, and the bending strength (Samples 3 to 10).

It was confirmed that the composite ferrite composition, in which the mixing ratio of the magnetic substance material and the low dielectric constant nonmagnetic substance material is without the range of the invention, shows deterioration in at least one or more evaluation items of the relative density, the permeability, the resonance frequency, the relative dielectric constant, the specific resistance, and the bending strength (Sample 1, 2 and 11).

Note sample 11 did not show the resonance frequency. This is caused by not observing the resonance peak of the permeability.

Example 2

The sintered bodies (the composite ferrite composition) were manufactured similarly with sample 8 of Example 1, except varying the composition of the low dielectric constant nonmagnetic substance material as shown in Table 2; and the same evaluations were carried out. Results are shown in Table 2. Note bending strength of the samples shown in Table 2 was not measured.

TABLE 2

| No. | compositions of a(bZnO•cCuO)•$SiO_2$ a | b | c | Relative density [vol %] | Permeability | Resonance frequency [MHz] | Relative dielectric constant | Resistivity [Ω · m] |
|---|---|---|---|---|---|---|---|---|
| 12* | 2.00 | 1.00 | 0.00 | 83.15% | 1.80 | 240.81 | 6.82 | 8.7E+07 |
| 8 | 2.00 | 0.98 | 0.02 | 98.60% | 2.36 | 240.90 | 7.31 | 4.8E+08 |
| 14 | 2.00 | 0.96 | 0.04 | 97.96% | 3.02 | 213.63 | 8.13 | 1.1E+08 |
| 15 | 2.00 | 0.90 | 0.10 | 97.23% | 3.14 | 205.25 | 8.05 | 2.3E+07 |
| 16 | 2.00 | 0.85 | 0.15 | 98.52% | 3.35 | 205.25 | 8.31 | 4.6E+06 |
| 17* | 2.00 | 0.82 | 0.18 | 99.14% | 3.53 | 213.63 | 8.42 | 6.3E+05 |
| 18* | 1.40 | 0.98 | 0.02 | 88.35% | 1.53 | 240.81 | 6.51 | 2.3E+07 |
| 19 | 1.50 | 0.98 | 0.02 | 91.67% | 1.97 | 231.44 | 6.84 | 8.8E+07 |
| 20 | 1.80 | 0.98 | 0.02 | 95.48% | 2.25 | 222.36 | 7.27 | 2.3E+08 |
| 8 | 2.00 | 0.98 | 0.02 | 98.60% | 2.36 | 240.90 | 7.31 | 4.8E+08 |
| 22 | 2.20 | 0.98 | 0.02 | 97.42% | 4.13 | 213.63 | 8.25 | 1.3E+08 |
| 23 | 2.40 | 0.98 | 0.02 | 92.86% | 3.92 | 213.63 | 7.82 | 9.2E+07 |
| 24* | 2.50 | 0.98 | 0.02 | 88.92% | 3.26 | 213.63 | 7.18 | 5.3E+07 |

"*" is Comp. Ex.

As shown in Table 2, it was confirmed that the composite ferrite composition, in which the low dielectric constant nonmagnetic substance material satisfy a predetermined composition, shows favorable results for every evaluation items of the relative density, the permeability, the resonance frequency, the relative dielectric constant, and the specific resistance (Samples 8, 14 to 16 and 19 to 23).

Meanwhile, it was confirmed that the composite ferrite composition, in which the low dielectric constant nonmagnetic substance material do not satisfy a predetermined composition, shows deterioration in either the relative density or the specific resistance (Samples 12, 17, 18 and 24).

Example 3

The sintered bodies (the composite ferrite composition) were manufactured similarly with sample 8 of Example 1, except varying content amount of bismuth oxide, which is the nonmagnetic substance material, as shown in Table 3. The same evaluations were performed except the resonance frequency was not measured. Results are shown in Table 3. Note sample 25 did not include the bismuth oxide and included 2.66 parts by weight of a commercial borosilicate glass with respect to 100 parts by weight of a total of the magnetic substance material and the low dielectric constant nonmagnetic substance material. Sample 26 did not include the bismuth oxide or the borosilicate glass. Sample 41 simultaneously included 1.50 parts by weight of the bismuth oxide and 0.50 parts by weight of the commercial borosilicate glass.

TABLE 3

| No. | Mixing ratio Magnetic substance material:Low dielectric constant nonmagnetic substance material | $Bi_2O_3$ [parts by weight] | Borosilicate glass [parts by weight] | Relative density[%] | Permeability | Relative dielectric constant | Resistivity [Ω · m] | Bending strength [MPa] |
|---|---|---|---|---|---|---|---|---|
| 1* | 100%:0% | 1.50 | 0.00 | 99.14% | 111.92 | 14.02 | 2.9E+07 | 135.49 |
| 25* | 30%:70% | 0.00 | 2.66 | 99.58% | 1.64 | 7.14 | 1.0E+09 | 80.12 |
| 26* | 30%:70% | 0.00 | 0.00 | 75.56% | 1.90 | 4.96 | 1.2E+06 | 50.34 |
| 27 | 30%:70% | 0.50 | 0.00 | 95.12% | 2.28 | 7.43 | 1.2E+10 | 101.99 |
| 28 | 30%:70% | 0.75 | 0.00 | 97.45% | 2.38 | 7.29 | 1.2E+10 | 128.79 |
| 28a | 30%:70% | 1.00 | 0.00 | 98.10% | 2.35 | 7.30 | 5.0E+09 | 130.56 |
| 8 | 30%:70% | 1.50 | 0.00 | 98.60% | 2.36 | 7.31 | 4.8E+08 | 135.42 |
| 41 | 30%:70% | 1.50 | 0.50 | 99.02% | 2.10 | 8.01 | 2.8E+07 | 103.18 |
| 29a | 30%:70% | 2.00 | 0.00 | 99.12% | 2.41 | 7.91 | 4.2E+08 | 151.38 |
| 29 | 30%:70% | 3.00 | 0.00 | 99.92% | 2.52 | 8.41 | 1.8E+08 | 166.15 |
| 30 | 30%:70% | 4.50 | 0.00 | 99.64% | 2.43 | 9.16 | 3.9E+07 | 198.24 |
| 30a | 30%:70% | 5.00 | 0.00 | 99.68% | 2.39 | 9.32 | 1.0E+07 | 191.56 |
| 31 | 30%:70% | 6.00 | 0.00 | 99.73% | 2.38 | 9.84 | 7.2E+06 | 184.23 |
| 32 | 30%:70% | 8.00 | 0.00 | 99.93% | 2.31 | 10.53 | 3.1E+06 | 189.52 |

"*" is Comp. Ex.

As shown in Table 3, it was confirmed that the composite ferrite composition, in which the bismuth oxide is included, shows favorable results for every evaluation items of the relative density, the permeability, the relative dielectric constant, the specific resistance, and the bending strength (Samples 8, 27 to 32 and 41).

In addition, according to the samples 8, and 27 to 32, bending strength tends to increase as content amount of the bismuth oxide is high, and the relative dielectric constant tends to decline and the specific resistance tends to increase as the content amount of the bismuth oxide is low.

Meanwhile, it was confirmed that the composite ferrite composition, in which nonmagnetic substance materials such as the bismuth oxide, shows deterioration in the relative density and the bending strength (Sample 26).

Further, it was confirmed that the composite ferrite composition, not using the bismuth oxide and using the borosilicate glass, shows deterioration in the bending strength (Sample 25).

Example 4

The multilayer chip coil having the formation of FIG. 1 was manufactured, making the composite ferrite composition of the sample 8 (Example) as the base material. The multilayer chip coil of size 1 (0.5 mm of X-axis size, 1.0 mm of Y-axis size and 0.5 mm of Z-axis size) and the same of size 2 (0.3 mm of X-axis size, 0.6 mm of Y-axis size and 0.3 mm of Z-axis size) were respectively manufactured. The coil conductor of the multilayer chip coil was Ag. Alumina setter was used for firing of the multilayer chip coil. In addition, The multilayer chip coil of size 1 and the multilayer chip coil of size 2 were respectively manufactured, making the composite ferrite compositions of the sample 25 (Comp. Ex.), the sample 26 (Comp. Ex.), the sample 27 (Ex.) the sample 28a (Ex.), the sample 29a (Ex.), the sample 29 (Ex.), the sample 30a (Ex.), and the sample 32 (Ex.) as the base material. The above-mentioned multilayer chip coils were manufactured for 500 each.

In addition, considering sample 8 (Ex.) and the sample 32 (Ex.), the coil conductor was changed from Ag to an Ag—Pd alloy (Ag 90%, Pd 10%), and the multilayer chip coil was similarly manufactured.

The 500 multilayer chip coils were mounted on the substrate using a solder, and the crack generation rate was calculated from number of the multilayer chip coils, in which the crack is generated after passing through the reflow furnace (280° C.). Note power was applied to the multilayer chip coil by melting, solidification, and expansion of the solder used for mounting; and thus, there was a case when the cracks are generated after passing through the reflow furnace. Upon insufficient strength, the cracks are generated by unable to endure the power applied by melting, solidification, and expansion of the solder used for the mounting. Properties vary upon generation of the cracks. In the worst case, disconnection occurs. Note in the present examples, strength was determined preferable only upon 0.0% crack generation rate.

Further, presence or absence of Ag exudation in the above each multilayer chip coils was observed. In concrete, an alumina setter used for firing the multilayer chip coil was element analyzed using EPMA (electron beam microanalyzer); Ag exudation was determined present upon confirmation of Ag adhering. Absence of Ag exudation and no Ag adhering on alumina setter are preferable; however, an object of the present invention can be achieved even when there is Ag exudation.

Further, impedances variations of the abovementioned multilayer chip coil were evaluated. In concrete, impedance of 1 GHz was measured in the room temperature by the impedance analyzer (trade name: 4991A made by Agilent Technologies). The impedance mean value of the 500 multilayer chip coils was determined AVG1 and the impedance standard deviation of the 500 multilayer chip coils was determined $\sigma 1$, and $(3\sigma 1/AVG1)\times 100(\%)$ was determined an index of the impedance variations. Upon generation of Ag exudation, the coil caused short-circuit and the impedance varied. Namely, variations of the impedance become large, when many coils cause Ag exudation.

Further, variations of DC resistance Rdc of the abovementioned multilayer chip coils were evaluated. In concrete, DC resistance in the room temperature was measured by a digital ohm meter (trade name: AX111A made by Adex Co.). The DC resistance mean value of the 500 multilayer chip coil was determined AVG2 and the DC resistance standard deviation of the 500 multilayer chip coil was determined $\sigma 2$, and $(3\sigma 2/AVG2)\times 100(\%)$ was determined an index of the DC resistance variations. Upon generation of Ag exudation, the coil caused short-circuits and the DC resistance varied. Namely, variations of the DC resistance became large, when many coils caused Ag exudation.

TABLE 4

| | Base materials | $Bi_2O_3$ [parts by weight] | Borosilicate glass [parts by weight] | Coil conductor | Product size | Crack generation rate[%] | Presence of Ag exudation | Impedance variations [%] | Rdc variations [%] |
|---|---|---|---|---|---|---|---|---|---|
| Comp. Ex. | Sample 25 | 0.00 | 2.66 | Ag100% | Size 1 | 0.0 | none | 2.9 | 2.3 |
| | Sample 25 | 0.00 | 2.66 | Ag100% | Size 2 | 3.5 | none | 2.6 | 2.5 |
| Comp. Ex. | Sample 26 | 0.00 | 0.00 | Ag100% | Size 1 | 7.2 | none | 4.6 | 5.0 |
| | Sample 26 | 0.00 | 0.00 | Ag100% | Size 2 | 15.6 | none | 4.0 | 4.0 |
| Ex. | Sample 27 | 0.50 | 0.00 | Ag100% | Size 1 | 0.0 | none | 1.3 | 1.3 |
| | Sample 27 | 0.50 | 0.00 | Ag100% | Size 2 | 0.0 | none | 1.8 | 1.7 |
| Ex. | Sample 28a | 1.00 | 0.00 | Ag100% | Size 1 | 0.0 | none | 1.2 | 1.8 |
| | Sample 28a | 1.00 | 0.00 | Ag100% | Size 2 | 0.0 | none | 1.6 | 1.0 |
| Ex. | Sample 8 | 1.50 | 0.00 | Ag100% | Size 1 | 0.0 | none | 1.7 | 1.3 |
| | Sample 8 | 1.50 | 0.00 | Ag100% | Size 2 | 0.0 | none | 1.4 | 1.9 |
| Ex. | Sample 41 | 1.50 | 0.50 | Ag100% | Size 1 | 0.0 | none | 2.9 | 2.5 |
| | Sample 41 | 1.50 | 0.50 | Ag100% | Size 2 | 0.0 | none | 2.2 | 2.6 |
| Ex. | Sample 29a | 2.00 | 0.00 | Ag100% | Size 1 | 0.0 | none | 1.3 | 1.5 |
| | Sample 29a | 2.00 | 0.00 | Ag100% | Size 2 | 0.0 | none | 1.3 | 1.4 |
| Ex. | Sample 29 | 3.00 | 0.00 | Ag100% | Size 1 | 0.0 | none | 2.2 | 2.9 |
| | Sample 29 | 3.00 | 0.00 | Ag100% | Size 2 | 0.0 | none | 2.2 | 2.5 |
| Ex. | Sample 30a | 5.00 | 0.00 | Ag100% | Size 1 | 0.0 | none | 3.3 | 3.1 |
| | Sample 30a | 5.00 | 0.00 | Ag100% | Size 2 | 0.0 | none | 3.7 | 3.9 |
| Ex. | Sample 32 | 8.00 | 0.00 | Ag100% | Size 1 | 0.0 | present | 4.9 | 4.3 |
| | Sample 32 | 8.00 | 0.00 | Ag100% | Size 2 | 0.0 | present | 4.1 | 4.2 |
| Ex. | Sample 8 | 1.50 | 0.00 | Ag90% Pd10% | Size 1 | 0.0 | none | 1.8 | 1.4 |
| | Sample 8 | 1.50 | 0.00 | Ag90% Pd10% | Size 2 | 0.0 | none | 1.9 | 1.1 |
| Ex. | Sample 32 | 8.00 | 0.00 | Ag90% Pd10% | Size 1 | 0.0 | none | 1.2 | 1.3 |
| | Sample 32 | 8.00 | 0.00 | Ag90% Pd10% | Size 2 | 0.0 | none | 1.1 | 1.1 |

As shown in Table 4, according to the multilayer chip coil of size 1, cracks did not generate even when every base materials shown in Table 4 was used, except comparative example of Sample 26, in which bismuth oxide or borosilicate glass are not used. Namely, considering the multilayer chip coil of size 1, required strength could be secured even when using bismuth oxide or borosilicate glass.

To the contrary, considering the multilayer chip coil of size 2, which is smaller than size 1, cracks did not generate upon using the base materials of the composite ferrite composition of Examples using bismuth oxide, however, cracks generated upon using the base materials of the composite ferrite composition of Comparative Examples not using bismuth oxide. Namely, sufficient strength could be maintained by the multilayer chip coil of size 2 when using bismuth oxide; however, sufficient strength could not be maintained by the multilayer chip coil of size 2 when using borosilicate glass.

In addition, from table 4, Ag exudation tends to be generated and variations in the impedance and variations in DC resistance become large, as content amount of bismuth oxide is large. However, upon using Ag—Pd alloy as the coil conductor, Ag exudation became hardly generated unrelated to the amount of bismuth oxide.

DESCRIPTIONS OF THE NUMERALS

1, 1*a*: Multilayer chip coil
2: Ceramic layer
3, 3*a*: Internal electrode layer
4, 4*a*: Chip body
5: Terminal electrode
6: Through-hole electrode for connecting terminals
6*a*: Extracting electrode
30, 30*a*: Coil conductor

What is claimed is:

1. A composite ferrite composition comprising a magnetic substance material and a nonmagnetic substance material, in which the magnetic substance material is Ni—Cu—Zn based ferrite, the nonmagnetic substance material comprises a nonmagnetic substance material with a dielectric constant less than that of the magnetic substance material, and which is shown by a general formula: $a(bZnO.cCuO).SiO_2$ and satisfies a=1.5 to 2.4, b=0.85 to 0.98, c=0.02 to 0.15, and b+c=1.00 in said general formula, and a bismuth oxide, a mixing ratio of the magnetic substance material and the nonmagnetic substance material is 80 wt %:20 wt % to 10 wt %:90 wt %, and the composite ferrite composition comprises 0.5 to 8.0 parts by weight of the bismuth oxide in terms of $Bi_2O_3$, and 0.5 parts by weight or less, including 0 parts, of a borosilicate glass, when a total of the magnetic substance material and the nonmagnetic substance material is 100 parts by weight.

2. An electronic component comprising a lamination of a coil conductor and a ceramic layer, in which the coil conductor comprises Ag, and the ceramic layer comprises the composite ferrite composition as set forth in claim 1.

3. An electronic component comprising a lamination of a coil conductor and a ceramic layer, in which the coil conductor comprises Ag, and the ceramic layer comprises the composite ferrite composition as set forth in claim 1.

4. The composite ferrite composition as set forth in claim 1, which contains 0 parts of a borosilicate glass.

5. The composite ferrite composition as set forth in claim 1, which comprises 1.0 to 5.0 parts by weight of the bismuth oxide in terms of $Bi_2O_3$.

6. The composite ferrite composition as set forth in claim 1, which comprises 1.0 to 3.0 parts by weight of the bismuth oxide in terms of $Bi_2O_3$.

7. The composite ferrite composition as set forth in claim 1, which comprises 1.5 to 2.0 parts by weight of the bismuth oxide in terms of $Bi_2O_3$.

8. The composite ferrite composition as set forth in claim 1, wherein the bismuth oxide has an average particle size of 0.5 to 4.0 μm.

* * * * *